United States Patent [19]

Thompson

[11] 4,187,641

[45] Feb. 12, 1980

[54] LOUVRE WINDOWS

[75] Inventor: Norman Thompson, Bridgnorth, England

[73] Assignee: Beta Aluminium Products Limited, Bridgnorth, United Kingdom

[21] Appl. No.: 941,808

[22] Filed: Sep. 12, 1978

[30] Foreign Application Priority Data

Sep. 15, 1977 [GB] United Kingdom ..... 38487/77

[51] Int. Cl.[2] ..... E06B 7/08

[52] U.S. Cl. ..... 49/403; 49/51; 49/64

[58] Field of Search ..... 49/50, 51, 64, 403, 49/74

[56] References Cited

U.S. PATENT DOCUMENTS

| | | | |
|---|---|---|---|
| 3,113,355 | 12/1963 | Tracy et al. | 49/51 X |
| 3,375,608 | 4/1968 | Thompson | 49/403 |
| 3,460,289 | 8/1969 | Toth | 49/50 |

FOREIGN PATENT DOCUMENTS

| | | | |
|---|---|---|---|
| 1374919 | 8/1964 | France | 49/403 |

*Primary Examiner*—Kenneth Downey
*Attorney, Agent, or Firm*—Young & Thompson

[57] ABSTRACT

A blade holder for a louvre window comprises an elongated member having a longitudinally groove for retaining an end edge of a louvre blade, a rebate of cruciform cross-section formed in that surface of the elongated member which is disposed adjacent the surface of a window frame on which the blade holder is pivotally mounted, and a drive plate for pivotally mounting the elongated member on the window frame, the drive plate comprising a main body and a boss separated by a bearing portion, the bearing portion being in rotational engagement within an aperture in the window frame, and the boss having a cruciform cross-section so that it has a driving engagement with the rebate in the elongated member. Two hardened steel pins are mounted on the driving plate to extend axially through the boss to prevent removal of the louvre by sawing through the boss.

8 Claims, 2 Drawing Figures

LOUVRE WINDOWS

BACKGROUND OF THE INVENTION

This invention relates to louvre windows and is concerned with an improved method of interconnecting a blade holder and a drive plate.

Hitherto louvre windows have been particularly vulnerable to vandalism and unauthorised entry since it has been a fairly simple matter to remove a louvre blade from the window. One of the methods by which unauthorised entry through louvre windows has been effected has involved sawing through the drive plate, by means of which the louvre blade is pivotally mounted on the window frame, by inserting a saw blade between the blade holder and the window frame. The invention sets out to provide a blade holder for a louvre window incorporating means for preventing this.

SUMMARY OF THE INVENTION

According to the invention a blade holder for a louvre window comprises an elongated member having means for retaining an end edge of a louvre blade, a rebate of non-circular cross-section formed in that surface of the elongated member which, in use, is disposed adjacent the surface of a window frame in which the blade holder is pivotally mounted, a drive plate for pivotally mounting the elongated member on the window frame and comprising a main body and a boss separated by a bearing portion, the bearing portion being adapted for rotational engagement within an aperture in the window frame, and the boss having a configuration such that it has a driving engagement with said rebate, and at least one hardened pin mounted on the driving plate to extend axially thereof, said pin extending at least through said boss.

The provision of one or more hardened pins, which are preferably hardened steel pins, makes it extremely difficult or impossible to saw through the boss of the drive plate by means of a saw blade inserted between the blade holder and the window frame.

DESCRIPTION OF THE PREFERRED EMBODIMENT

Figure 1:
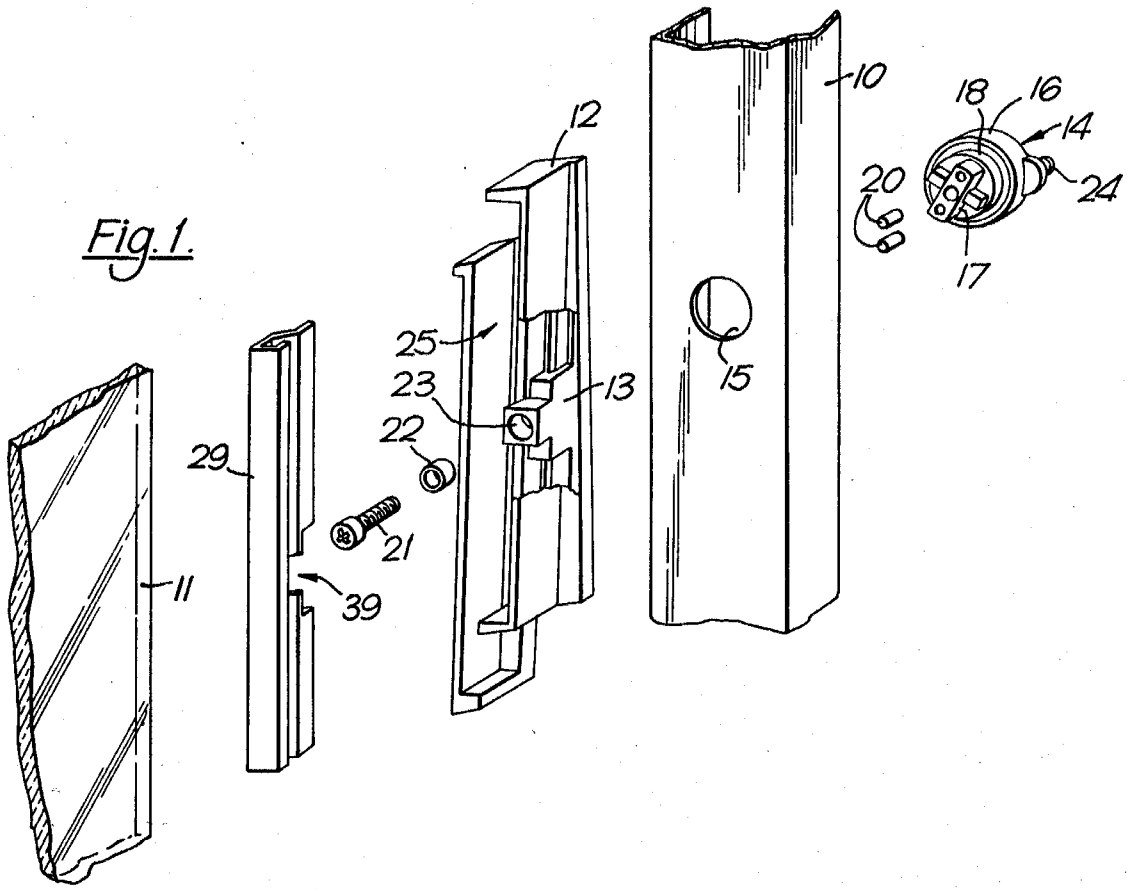
FIG. 1 is an exploded perspective view of some of the components of a louvre window, including a blade holder according to the invention.
Figure 2:
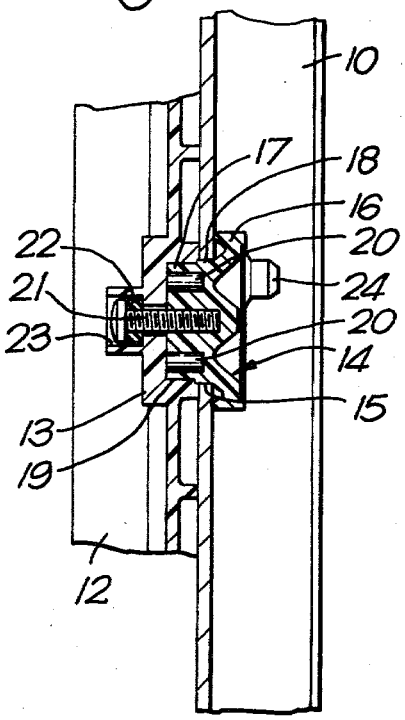
FIG. 2 is a vertical section through a part of the blade holder showing the means for pivotally mounting the blade holder on a window frame element.

The louvre window comprises a surrounding frame structure the jambs of which are formed from aluminium extrusions of channel section, and part of one vertical jamb 10 is shown in the drawings. Each louvre consists of a glass blade 11 opposite ends of which are each received in a blade holder. Each blade holder comprises an elongated member 12, for example formed as a one-piece moulding from a synthetic plastics material such as polypropylene, having a longitudinally extending groove 25 to receive one end edge of the glass louvre blade. A metal reinforcement element 29 is received in a further longitudinally extending groove contiguous with the first groove, so that the reinforcement element engages the louvre blade and can be bonded to it by an adhesive.

The elongated member 12 has a central hollow boss 13 which is engaged by a drive plate 14 which projects through a circular aperture 15 in the jamb 10. The reinforcement element is notched, as indicated at 39, so as to fit closely over the boss 13.

The drive plate 14 is formed as a moulding from an acetal resin and consists of a main body 16 and a boss 17 formed integrally therewith, the body and boss being separated by a bearing portion 18 of such dimension that, when the boss is passed through the aperture 15 formed in the jamb of the window frame, the body 16 bears against the surround of the aperture.

The bearing portion 18 of the drive plate is a close fit in the aperture 15 in the jamb and the boss 17 is of non-circular cross-section, for example of cruciform cross-section as shown, for making engagement with a rebate 19 of corresponding configuration formed in the boss 13 of the blade holder.

The boss 17 is formed with holes symmetrically disposed on diametrically opposite sides of the central axis of the drive plate, in two opposing arms of the cruciform section, which holes receive hardened steel pins 20. The length of the pins is such that they extend into the bearing portion 18 of the drive plate.

The pins 20 extend across the junction between the blade holder and the jamb 10 and prevent the drive plate being sawn through by a saw blade inserted between the blade holder and the jamb.

The blade holder is connected to the drive plate by means of a screw 21 which passes through the boss 13 and into the drive plate, a rubber washer 22 being disposed between the head of the screw and the base of a socket 23 in the boss which receives the head of the screw.

The part of the drive plate body remote from the jamb 10 includes two projecting pegs 24 to which a louvre operating linkage mechanism (not shown) is attached so that a drive can be transmitted from an operating mechanism to the louvre blade held by the blade holder.

I claim:

1. A blade holder for a louvre window comprising an elongated member, means on the elongated member for retaining an end edge of a louvre blade, a rebate of non-circular cross-section formed in that surface of the elongated member which, in use, is disposed adjacent the surface of a window frame on which the blade holder is pivotally mounted, a drive plate for pivotally mounting the elongated member on the window frame, said drive plate comprising a main body and a boss separated by a bearing portion, the bearing portion being adapted for rotational engagement within an aperture in the window frame, and the boss having a configuration such that it has a driving engagement with said rebate, and at least one hardened pin mounted on the driving plate to extend axially thereof, said pin extending at least through said boss.

2. A blade holder according to claim 1, wherein the hardened pin is received in an axially extending hole in said drive plate.

3. A blade holder according to claim 1, wherein said pin extends into the bearing portion of the drive plate.

4. A blade holder according to claim 1, wherein there are provided two hardened pins on the drive plate.

5. A blade holder according to claim 4, wherein said hardened pins are symmetrically disposed on diammetrically opposite sides of the central axis of the drive plate.

6. A blade holder according to claim 5, wherein said boss of the drive plate is of cruciform cross-section and the rebate is of corresponding configuration for making engagement therewith, and said hardened pins are each received in holes extending axially through arms of the cruciform section.

7. A blade holder according to claim 1, wherein said pins are circular in cross-section.

8. A blade holder according to claim 1, wherein said pins are formed from hardened steel.

* * * * *